US010612877B1

(12) United States Patent
Harris

(10) Patent No.: US 10,612,877 B1
(45) Date of Patent: Apr. 7, 2020

(54) DETACHABLE GUN TRIGGER LOCK ASSEMBLY

(71) Applicant: Dennis Harris, Provo, UT (US)

(72) Inventor: Dennis Harris, Provo, UT (US)

( * ) Notice: Subject to any disclaimer, the term of this patent is extended or adjusted under 35 U.S.C. 154(b) by 0 days.

(21) Appl. No.: 16/154,637

(22) Filed: Oct. 8, 2018

(51) Int. Cl.
*F41A 17/54* (2006.01)

(52) U.S. Cl.
CPC ..... *F41A 17/54* (2013.01)

(58) Field of Classification Search
CPC ..... F41A 17/54; F41C 33/06
See application file for complete search history.

(56) References Cited

U.S. PATENT DOCUMENTS 3,307,755 A * 3/1967 Lentz ..... F41C 33/06 206/317
5,621,996 A * 4/1997 Mowl, Jr. ..... F41A 23/18 211/64
5,680,723 A * 10/1997 Ruiz ..... F41A 17/44 42/70.07
5,768,819 A * 6/1998 Neal ..... F41A 17/00 42/70.07
6,438,885 B1 * 8/2002 Murray ..... F41A 17/54 211/64
2003/0066228 A1 * 4/2003 Smith ..... F41A 17/54 42/70.11
2004/0083778 A1 * 5/2004 Loeff ..... E05B 53/003 70/63
2012/0005935 A1 * 1/2012 Chandler ..... F41A 17/04 42/70.11
2016/0377362 A1 * 12/2016 Farr ..... F41A 17/04 42/70.06

* cited by examiner

*Primary Examiner* — Gabriel J. Klein
(74) *Attorney, Agent, or Firm* — Steven Rhinehart

(57) ABSTRACT

An improvised gun lock assembly formed of two major components which alternatively slide together around a slide, trigger and/or action of a firearm, or alternatively formed by two hingedly-connected lateral halves which clamp down around the trigger, slide and/or action of a firearm. The assembly may comprise an arcuate member enveloping a barrel and action.

10 Claims, 10 Drawing Sheets

DETACHABLE GUN TRIGGER LOCK ASSEMBLY

FIELD OF THE INVENTION

This invention relates to safety mechanisms for firearm securement, and more particularly relates to improvised gun lock for securing and rendering firearms inutile.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

A major concern of gun owners is that unauthorized access to loaded guns often results in accidental injury or a death of a person. Gun trigger locks prevent the unauthorized use of the firearm as well as deter unauthorized use of stolen guns.

A variety of trigger locking devices have been designed and introduced into the art over a period of decades to provide safety locking features for firearms and to prevent accidental or intentional injury and death. The art includes gun locks built to prevent movement of the trigger and locks integrated into the firearm to prevent movement of the hammer. Still other locking mechanisms in the art surround the trigger and/or trigger guard, preventing movement of the trigger. These previously designed locks in the art have been defeatable by determined users and not adequately disabled the entire weapon, usually focusing on just the trigger, trigger guard, barrel, or slide.

Semiautomatic and selective fire firearms automatically cycle spent cartridges from the action of the weapon and re-chamber a fresh load from a magazine or feed until the magazine or feed is depleted. Semiautomatic firearms may incorporate closed-bolt firing mechanisms, open-bolt firing mechanisms, or other mechanisms known to those of skill in the art. The ejection port for ammunition in these firearms is usually located directly above the trigger guard.

There have been many prior attempts to block access to the trigger guard, but there are no locking mechanisms in the art which disable the trigger, ejection port and slide simultaneously. Safety locks and clamps positioned on trigger guards have proven to be impractical, clumsy, and inconvenient.

With the foregoing in mind it is, therefore, a primary object of the present invention to provide an adjustable gun trigger lock which meets all of the foregoing requirements, and which disables the gun holistically, including the trigger, slide, and other functions, blocking access to the whole of the firearm and rendering the firearm disabled while the trigger lock is in place.

A more specific object of the invention is to provide an adjustable gun trigger lock adapted to envelope using an arcuate member the functional components of a firearm. In view of the foregoing, it should be clear that there is a need in the industry for an apparatus and means of more efficiently rendering a firearm inutile.

SUMMARY

From the foregoing discussion, it should be apparent that a need exists for an apparatus for an improvised, detachable gun trigger lock assembly. Beneficially, such an apparatus would provide a plurality of features and components efficacious for helping to cure the above-described deficiencies in the prior art. These features create a lock which is efficacious for enhanced control and security of the firearm.

The present invention has been developed in response to the present state of the art, and in particular, in response to the problems and needs in the art that have not yet been fully solved by currently available apparatus. Accordingly, the present invention has been developed to provide a gun lock assembly (or "gun lock") for disabling a firearm, the assembly (or "gun lock") comprising: an arcuate upper shackle adapted to affix over one or more of the barrel and slide of a firearm, wherein the arcuate upper shackle covers an ejection port of the firearm and partially envelopes the barrel, the arcuate upper shackle defining: an upper recess for receiving the barrel of the firearm, the upper recess contouring outward surfacing of the firearm, the upper recess passing through the upper shackle, a lower recess for receiving a trigger guard of the firearm, the lower recess passing through only a portion of the upper shackle; a track for slidably receiving a flange on a lower member; an elongate lower cylindrical member, having a flange adapted to slide within the track, the elongate lower member adapted to interlock over a trigger guard with the upper shackle; a locking mechanism adapted to interlock the upper shackle and lower member.

The assembly may further comprise an electroacoustic transducer and power supply adapted to emanate an alarm. The lower member may be substantially cylindrical. The assembly may additionally or alternatively further comprise a biometric lock.

A second gun lock assembly for disabling a firearm is also provided, the assembly comprising: a left shackle adapted to affix over a barrel and a slide of a firearm, wherein the left shackle is hingedly affixed on a top edge to a right shackle, the left shackle defining a hollow interior recess contoured to closely envelope one or more of a trigger guard, trigger, slide and barrel of a firearm; a right shackle adapted to affix over a barrel and a slide of a firearm, wherein the right shackle is hingedly affixed on a top edge to a left shackle, the left shackle defining a hollow interior recess contoured to closely envelope one or more of a trigger guard, trigger, slide and barrel of a firearm; a locking mechanism adapted to interlock the right shackle and left shackle together over a trigger guard of a firearm.

The assembly may further comprise an electroacoustic transducer and power supply adapted to emanate an alarm. The lower member may be substantially cylindrical. The assembly may further comprise a biometric lock.

The assembly may further comprise one or more of a wireless transceiver for connecting to a LAN and components adapted to share media wirelessly with one or more separate headphones using Bluetooth® technology.

The assembly may be adapted to automatically relay a notification wirelessly that the assembly has been one of removed and moved.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method.

Figure 1:
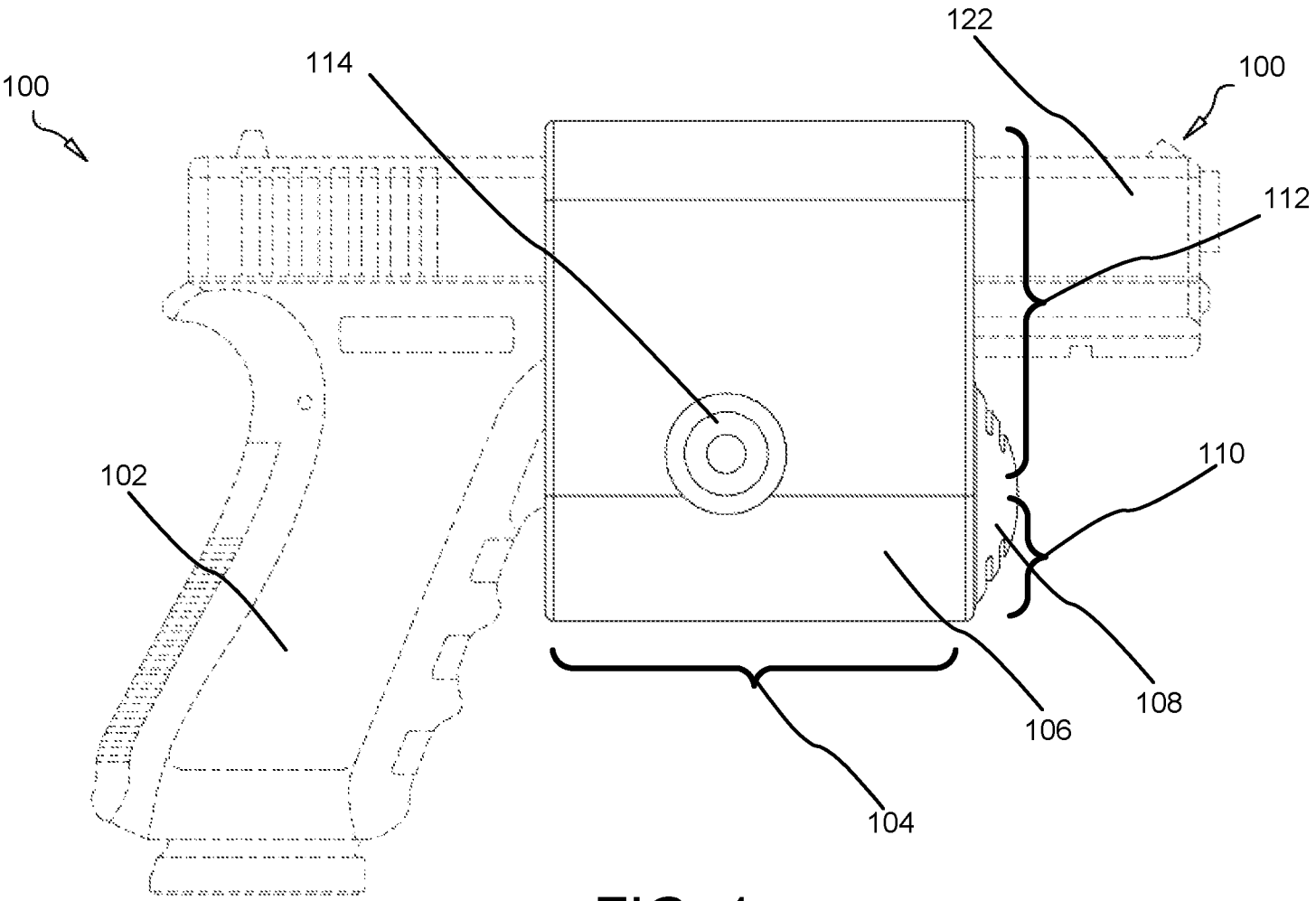
FIG. 1 is an environmental, side perspective view illustrating one embodiment of an improvised detachable gun, trigger lock assembly in accordance with the present invention.

FIG. 1 is an environmental, side perspective view illustrating one embodiment of an improvised detachable gun, trigger lock assembly 100 in accordance with the present invention.

The assembly 100 includes a detachable semi-block-shaped gun lock housing 104 which separates into upper and lower members 110, 112. The upper member 112 forms an elongated, substantially U-shaped shackle circumscribed and partially enveloping the action and barrel of the firearm 102. The upper member 112 (or upper shackle 112) is noncylindrical and comprises substantially planar left and right lateral side surfaces. The upper member 112 is operable to affix over the barrel and action of a firearm. The upper member 112 slidably receives the lower member 110, which positions within an interior track on the upper member 112.

The lower member 110, in the shown embodiment, slides over a trigger and trigger guard of a firearm 102 and positions beneath the barrel and action of the firearm, interlocking with and/or latching to the upper member 112.

The assembly 100 includes a locking mechanism 114. The shown locking mechanism 114 is operable as a key locking mechanism, but may also include a combination lock or biometric lock as known to those of skill in the art. The locking mechanism 114 is operable to release the lower member 110 when unlocked, and to secure the lower member 110 in place when locked.

Figure 2:
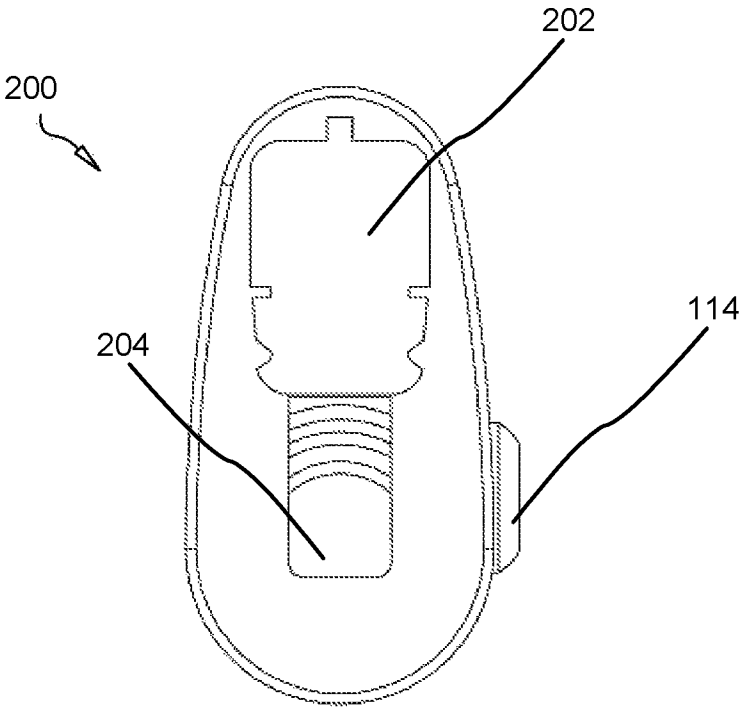
FIG. 2 is a rear perspective view illustrating one embodiment of an improvised detachable gun, trigger lock assembly in accordance with the present invention.

FIG. 2 is a rear perspective view illustrating one embodiment of an improvised detachable gun, trigger lock assembly 200 in accordance with the present invention.

The upper member 112 defines to adjoining recesses 202, 204. The higher recess 202 receives the barrel and action of the firearm 102 and contours the outward edges of the barrel and action, which traverse the upper member 112 and protrude from the forward open end of the upper member 112. The higher recess 202 traverses the upper member 112 from rear to forward ends allowing the received barrel to pass entire through the upper member 112 in the received position.

The upper member 112 defines a slot, or lower recess 204, for receiving the trigger guard of a firearm 102. The lower recess is dimension to contour substantially the trigger guard which is fully enveloped by the member 110, 112 surrounded the trigger guard. The lower recess 204 is open on the rearward surface of the assembly 200 but does not traverse entirely the assembly 200 and pass through the assembly to the forward surface. The interior recess 204 defined by the upper member is complimentary in shape to the trigger guard of the firearm 102 for which the embodiment 200 was specifically designed, or generically shaped to house and receive a plurality of common trigger guard shapes and dimensions.

Figure 3:
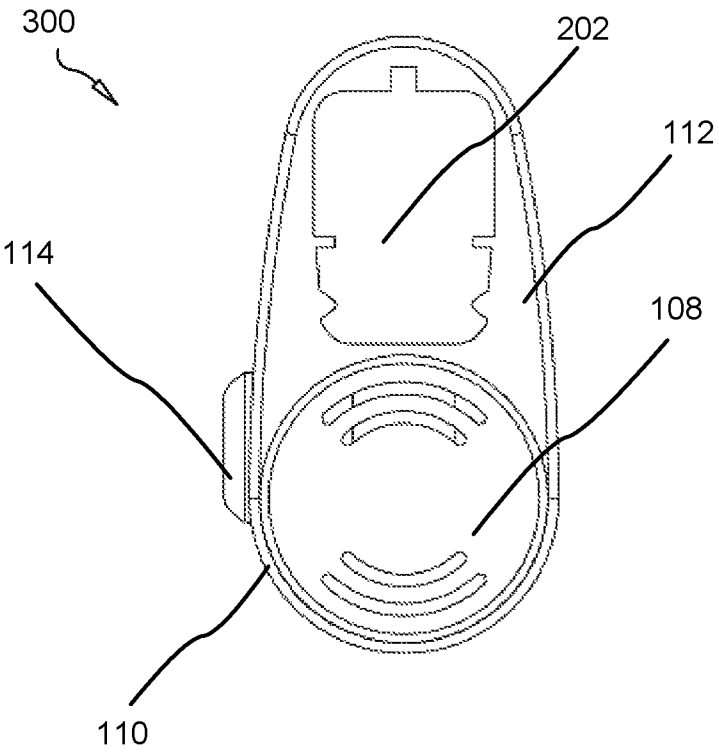
FIG. 3 is a forward perspective view illustrating one embodiment of an improvised detachable gun, trigger lock assembly in accordance with the present invention.

FIG. 3 is a forward perspective view illustrating one embodiment of an improvised detachable gun, trigger lock assembly 300 in accordance with the present invention.

The upper recess 202 is shown which permits the barrel, slide and/or action to pass through the upper member 112. The lower member 110 is affixed in a locked configuration with the upper member 112.

The lower member 110 comprises a plurality of internal components in various embodiments, including a power supply 1302 (further described below); a electroacuoustic transducer 108 (or speaker); and a biometric lock 1306 or fingerprint biometric lock, which includes a servo motor, a shaft, a cam, a controller board, a sensor, a memory device for encoded fingerprint data, and other internal mechanism known to those of skill in the art for imparting biometric locking function the apparatus 300.

The speaker 108 juts forward of the lower member 110 in some embodiments to increase sound emanation.

Figure 4:
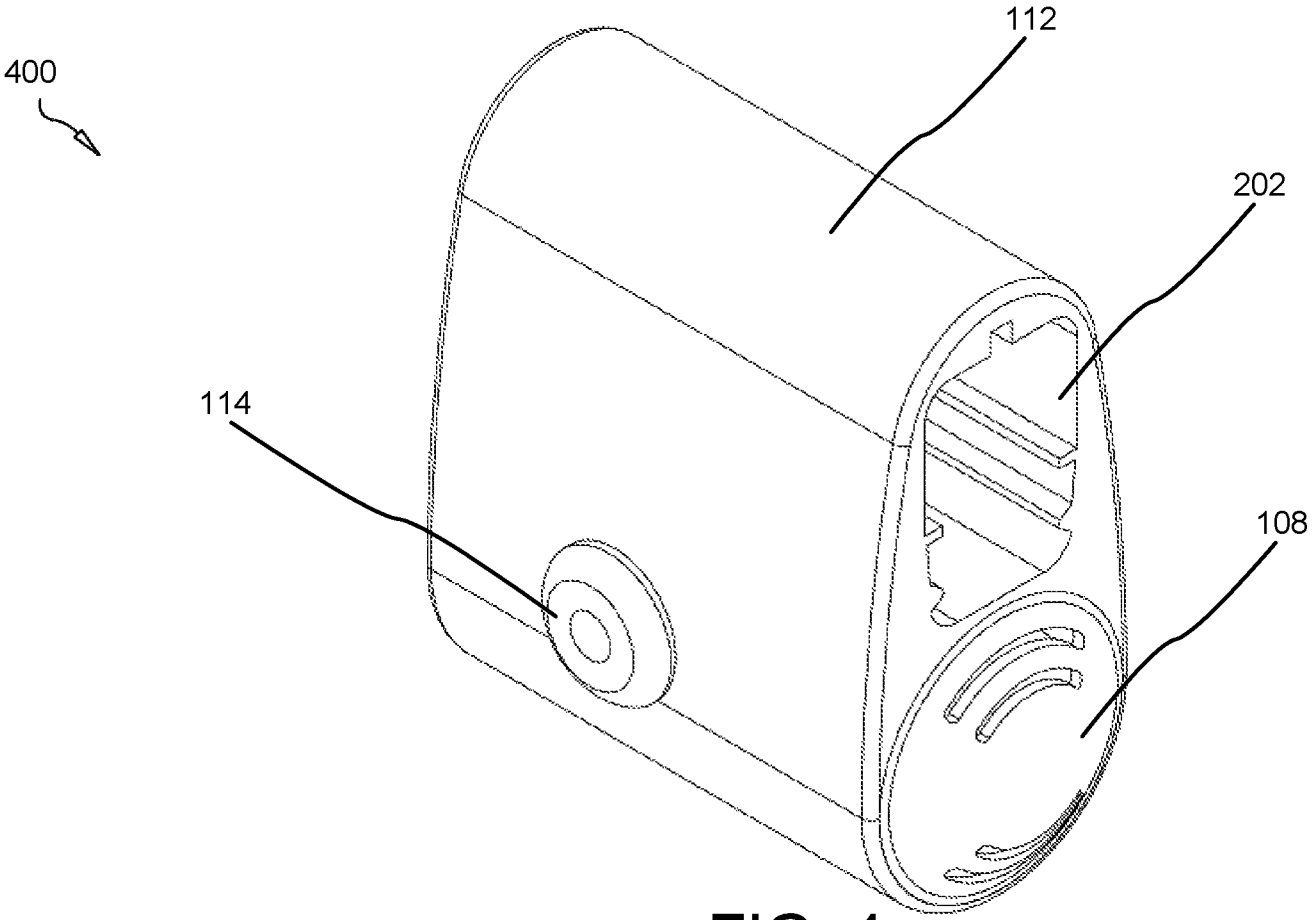
FIG. 4 is a forward, side perspective view illustrating one embodiment of an improvised detachable gun, trigger lock assembly in accordance with the present invention.

FIG. 4 is a forward, side perspective view illustrating one embodiment of an improvised detachable gun, trigger lock assembly 400 in accordance with the present invention.

As shown, the upper member is substantially arcuate.

Figure 5:
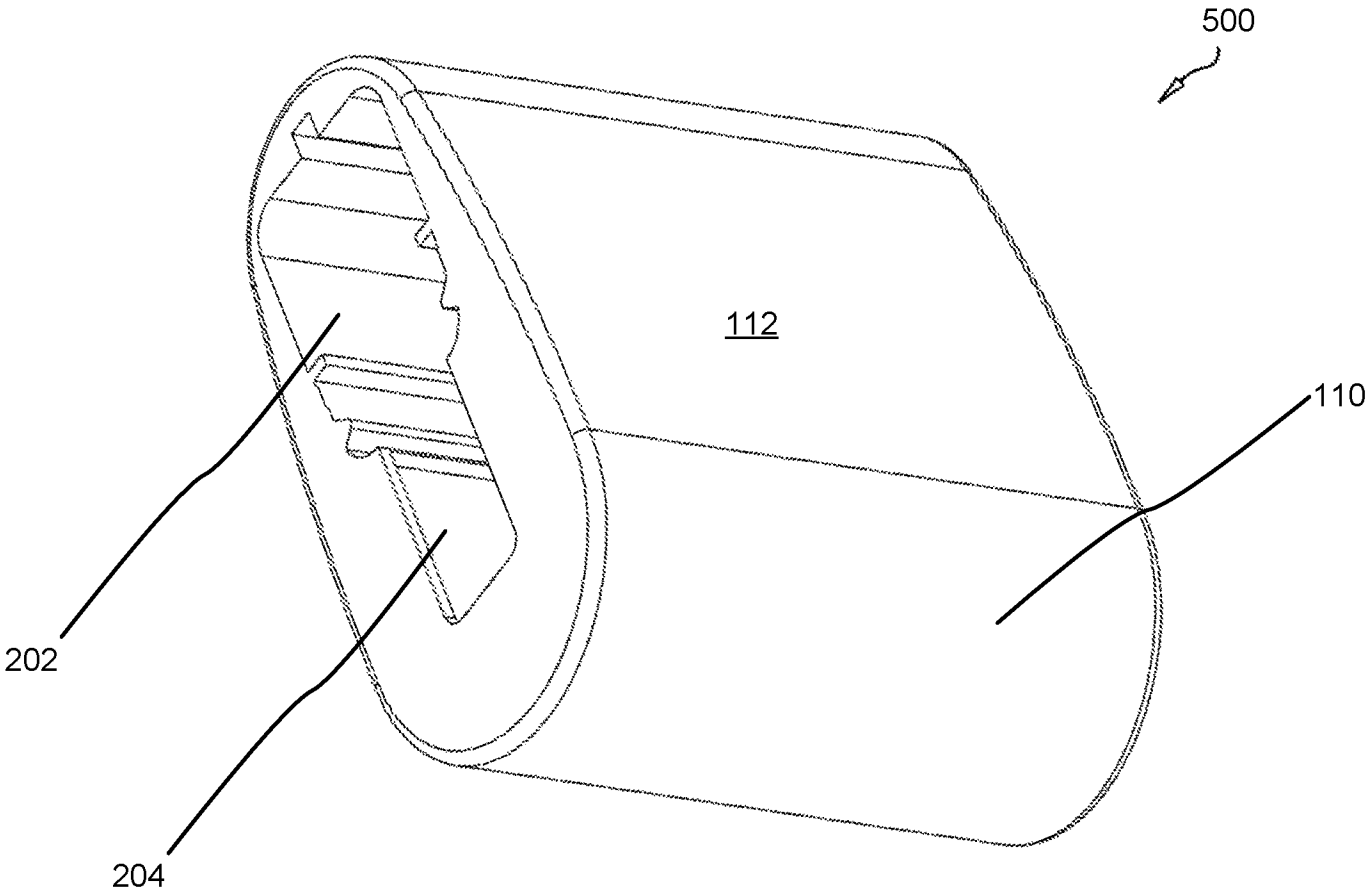
FIG. 5 is a lower, rear side perspective view illustrating one embodiment of an improvised detachable gun, trigger lock assembly in accordance with the present invention.

FIG. 5 is a lower, rear side perspective view illustrating one embodiment of an improvised detachable gun, trigger lock assembly 500 in accordance with the present invention.

The top surface of the upper member 112 is non-planar in the shown embodiment. The upper member 112 is arcuate, and rounds around the barrel, slide and other action components of the firearm 102.

Figure 6:
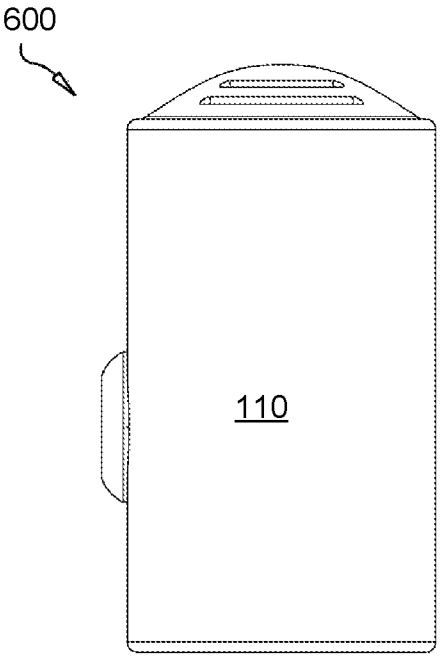
FIG. 6 is a lower perspective view illustrating one embodiment of an improvised detachable gun, trigger lock assembly in accordance with the present invention.

FIG. 6 is a lower perspective view illustrating one embodiment of an improvised detachable gun, trigger lock assembly 600 in accordance with the present invention.

As shown.

Figure 7:
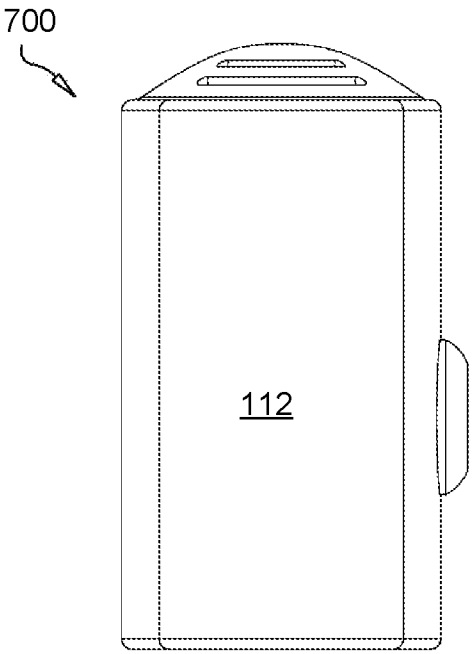
FIG. 7 is an upper perspective view illustrating one embodiment of an improvised detachable gun, trigger lock assembly in accordance with the present invention.

FIG. 7 is an upper perspective view illustrating one embodiment of an improvised detachable gun, trigger lock assembly 700 in accordance with the present invention.

As shown.

Figure 8:
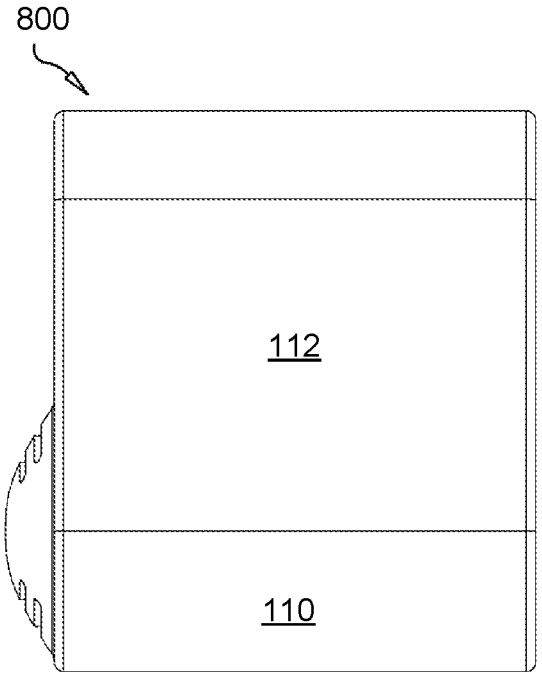
FIG. 8 is a side perspective view illustrating one embodiment of an improvised detachable gun, trigger lock assembly in accordance with the present invention.

FIG. 8 is a side perspective view illustrating one embodiment of an improvised detachable gun, trigger lock assembly 800 in accordance with the present invention.

As shown.

Figure 9:
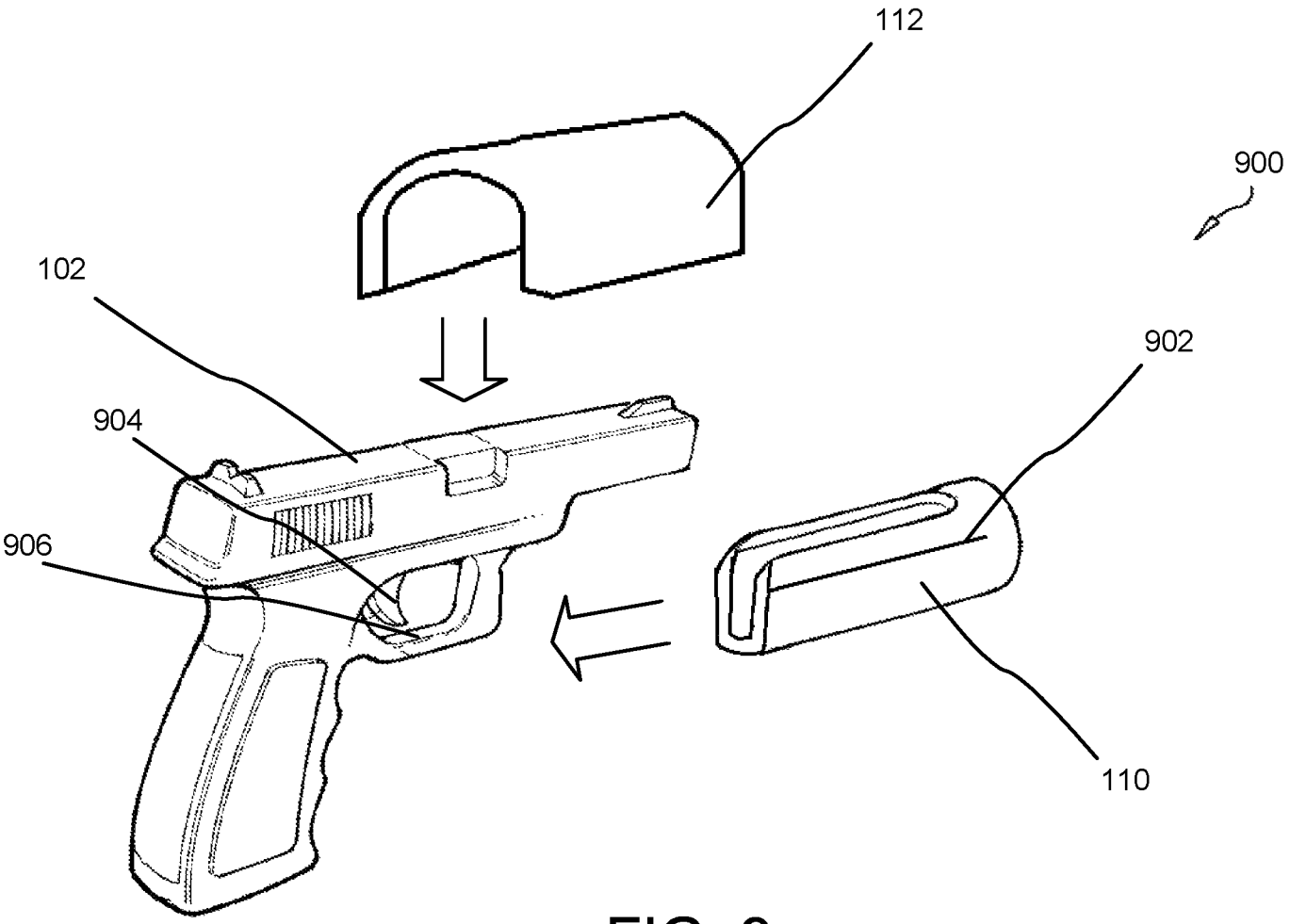
FIG. 9 is a rear, side environmental perspective view illustrating one embodiment of an improvised detachable gun, trigger lock assembly in accordance with the present invention.

FIG. 9 is a rear, side environmental perspective view illustrating one embodiment of an improvised detachable gun, trigger lock assembly 900 in accordance with the present invention.

The upper member 112 affixed down over the firearm 102 after which the lower member 110 slides into place below the upper member 112.

In operation, the elongate lower member 110 is oriented with a proximal end pointed towards the firearm 102, and a distal end pointed away from the firearm 102. The lower member 110 includes a flange 902 (or guide member 902). The flange 902 is configured to slide within a track defined by the upper member 112.

When the flange 902 is adjacently positioned with the track, the elongate lower member 110 slides into the upper member 112 and interlocks therewith.

Figure 10:
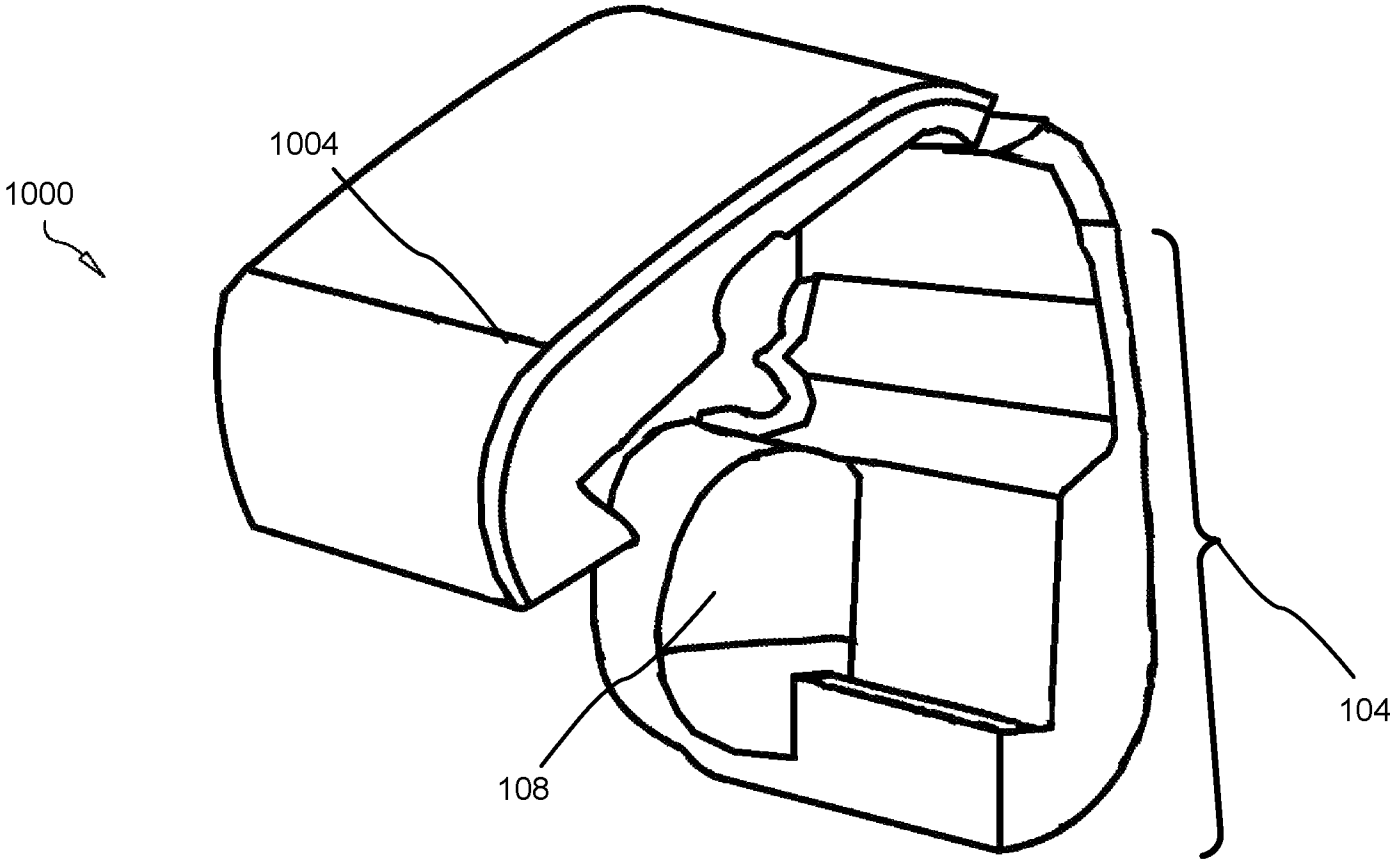
FIG. 10 is a rear, side perspective view illustrating one embodiment of an improvised detachable gun, trigger lock assembly in accordance with the present invention.

FIG. 10 is a rear, side perspective view illustrating one embodiment of an improvised detachable gun, trigger lock assembly 1000 in accordance with the present invention.

The shown embodiment varies from the embodiments shown in FIGS. 1-9 inasmuch as the housing 104 in the shown embodiment is divided into two hingedly connected lateral halves 1002, 1004 rather than upper and lower members 112, 110.

The left lateral housing member 1004 is hingedly affixed along its top or bottom edge to the right lateral housing member 1002. The left lateral housing member 1004 and right lateral housing member 1002 clamp down, affix and lock over the barrel, trigger guard, and slide of the firearm 102 as shown.

Figure 11:
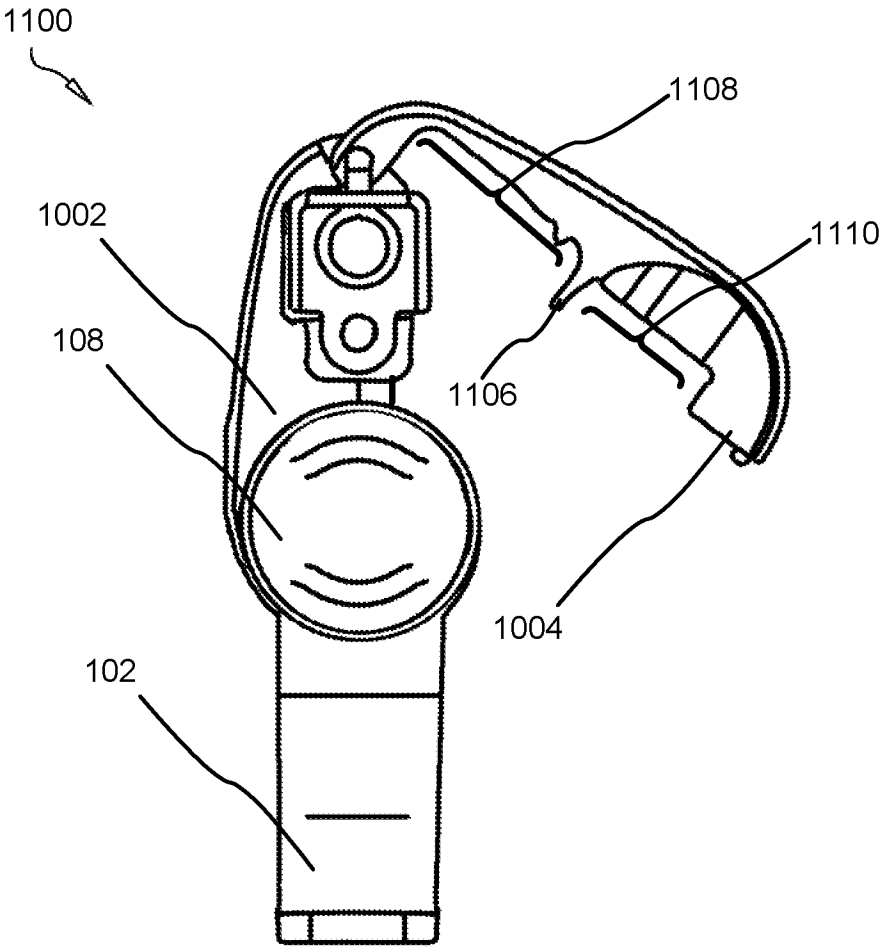
FIG. 11 is a forward perspective view illustrating one embodiment of an improvised detachable gun, trigger lock assembly in accordance with the present invention.

FIG. 11 is a forward perspective view illustrating one embodiment of an improvised detachable gun, trigger lock assembly 1100 in accordance with the present invention.

The left lateral housing member 1004 (or left shackle 1004) comprises a cantilever 1106 which juts laterally from an inside surface of the left lateral housing member 1004 and positions beneath the slide 122 of the firearm 102 and which positions above the trigger 904 of the firearm. The terms "right lateral housing member 1002" and "right shackle" are synonymous for the purposes of this disclosure. The terms "left lateral housing member 1004" and "left shackle" are synonymous for the purposes of this disclosure.

The right lateral housing member 1002 may also comprise a cantilever 1106.

The left lateral housing member 1004 defines two recesses 1108, 1110. The upper recess 1108 is shaped to contour exterior surfacing of a firearm 102 slide 122. The lower recess 1110 is shaped to contour and affix around a trigger guard 906 of a firearm 102.

The left lateral housing member 1004 has a beveled, curved or chamfered upper surface in the shown embodiment such that when clamped down around the trigger guard 906 and interlocked together, the assembly 1100 forms an arcuate upper surface enveloping, wholly or partially, the barrel of the firearm.

Figure 12:
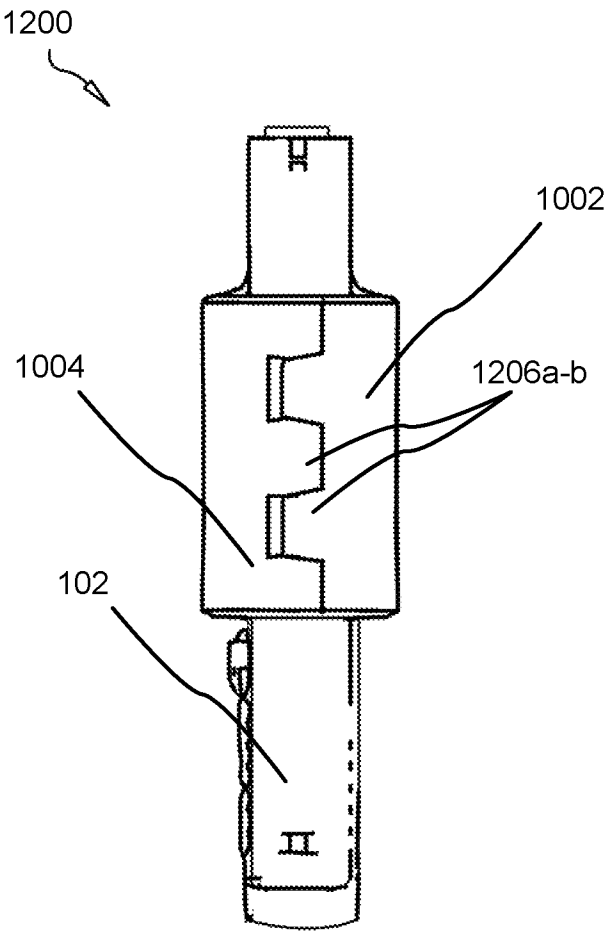
FIG. 12 is a top perspective view illustrating one embodiment of an improvised detachable gun, trigger lock assembly in accordance with the present invention.

FIG. 12 is a top perspective view illustrating one embodiment of an improvised detachable gun, trigger lock assembly 1200 in accordance with the present invention.

The left lateral housing member 1002 and the right lateral housing member 1004 are hingedly connected along the top surfaces and each comprise one or more teeth 1206 (or prongs 1206) which interlock and are affixed along a single axis to form a hinge as shown.

Figure 13:
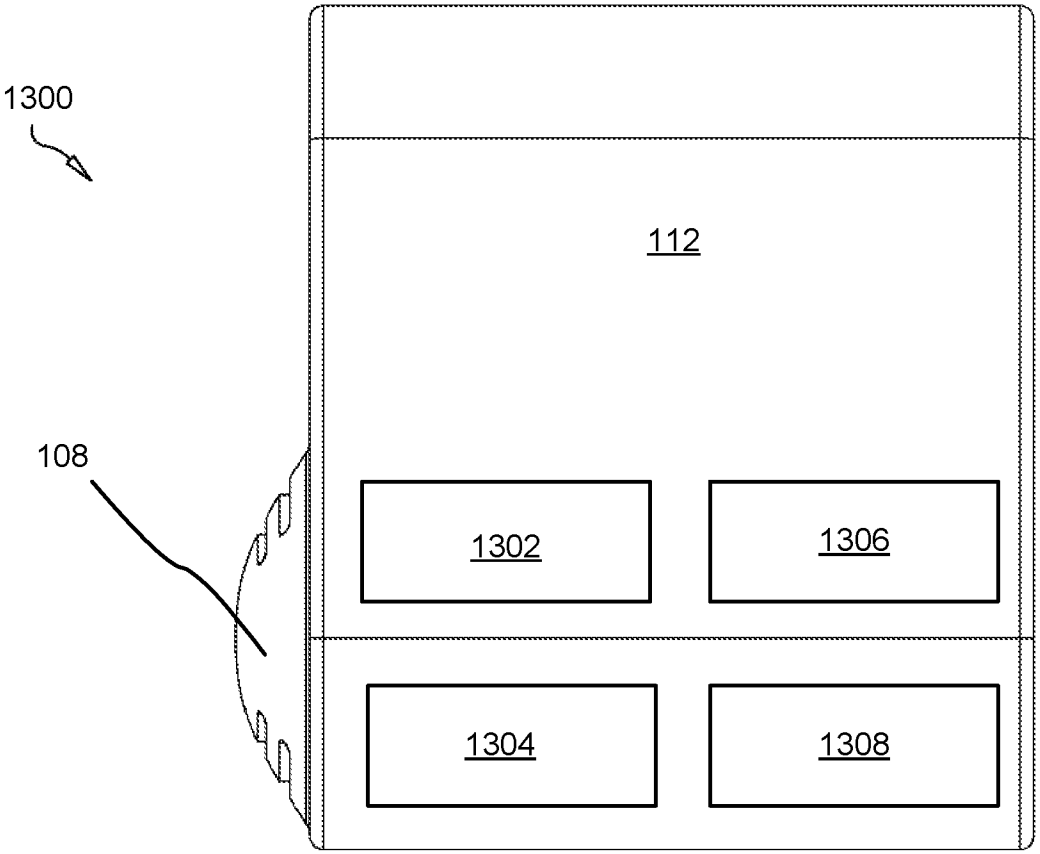
FIG. 13 is a sectioned, side perspective view illustrating one embodiment of an improvised detachable gun, trigger lock assembly in accordance with the present invention.

FIG. 13 is a sectioned, side perspective view illustrating one embodiment of an improvised detachable gun, trigger lock assembly 1300 in accordance with the present invention.

The assembly 1300 may be adapted to share information wirelessly with one or more separate DPDs using Bluetooth® technology. The assembly 1300 comprises means for relaying and receiving electrical signals enabling device-to-device communication (meaning wireless transmission of media between the assembly 1300 and a separate DPD). The assembly 1300 may be configured to make use of the Bluetooth® protocols and procedures enabling DPD intercommunication connectivity. This functionality may be provided by incorporating the Bluetooth Intercom Profile® and/or the Bluetooth Telephony Profile®, or other wireless technologies known to those of skill in the art.

This communication may be in accordance with core specifications of one or more subsets of Bluetooth® profiles, wherein the core specifications comprise one or more of: the Cordless Telephony Profile (CTP), the Device ID Profile (DIP), the Dial-up Networking Profile (DUN), the File Transfer Profile (FTP), the Hands-Free Profile (HFP), the Human Interface Device Profile (HID), the Headset Profile (HSP), and the Intercom Profile (ICP), the Proximity Profile (PXP).

Multiple assemblies 1300 may be networked together and information including media exchanged between them wirelessly such that if the lock of any firearm 102 is breached, an alarm sounds, or a warning/notification is pushed to a technology provider or firearm owner. In various embodiments, the assembly comprises a camera which records into computer-readable storage images and/or video, the media comprising video, audio and/or images taken before the assembly 1300 was breached. For instance, a breach notification may be pushed between adjoining, interconnected assemblies 1300. All assemblies 1300 may be configured to tone an audible alarm when any of the assemblies 1300 in the network are breached or unlocked.

The assembly 1300 may further comprise a wireless receiver 1308 for interconnecting the assembly 1300 wireless over a WAN (Wide Area Network) or LAN (Local Area Network). The assembly 1300 may be adapted to receive wireless input via the wireless receiver 1308 transmitted from a tablet computer or other DPD.

The assembly 1300 may comprise a tracking system for tracking or locating the firearm 102 using a transmitter or transceiver 1304 in the assembly 1300 in combination with GPS positioning system for monitoring and relaying radio frequency signals from the battery powered assembly 1300 to a user and technology provider with information as to the location of the assembly 1300 and/or to track the firearm 102 if stolen.

The firearm 102 comprises a semi-automatic firearm in the preferred embodiment as the slide member is covered by the assembly 1300. The firearm slide 122 is unable to slide to a rearward position of the firearm 102 when obstructed by the assembly 1300, thereby rendering the firearm 102 inert. In this manner, the assembly 1300 locks the firearm 102. The slide 122 is disposed to position inside the assembly 1300.

The assembly 100 prevents discharge of the firearm 102, deters theft, and exhibits increased protection of the firearm 102 over other trigger locking mechanisms known in the art. These functions improve locking and securing functions.

Figure 14:
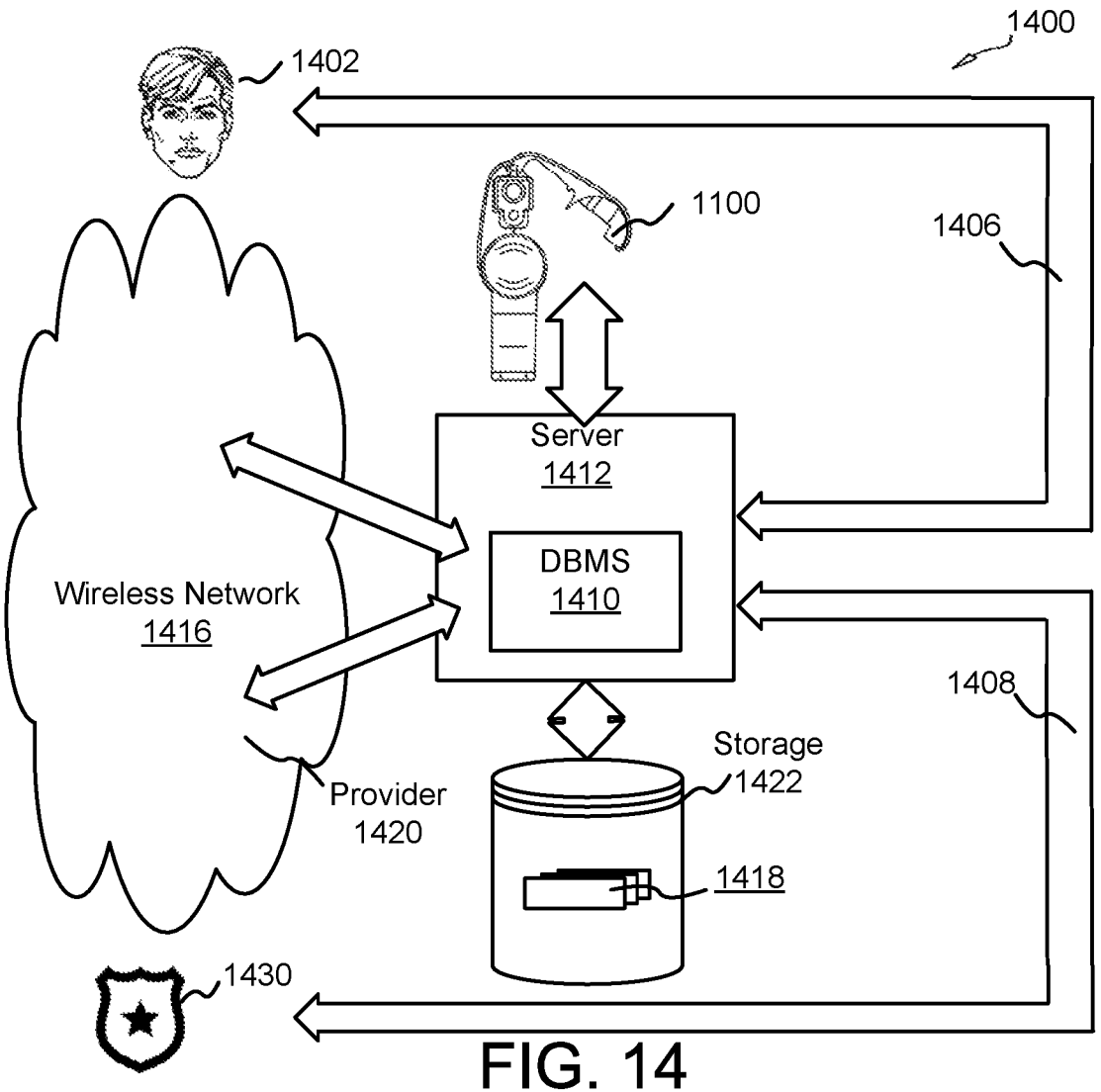
FIG. 14 is an entity-relationship diagram illustrating data flow between entities in accordance with the present invention.

FIG. 14 is an entity-relationship diagram illustrating data flow between entities in accordance with the present invention.

The device 1100 may communicate with a server a server 1412, a database management system (DBMS) 1410, persistent storage 1422, stored notifications 1418, a wireless network 1416, a home owner 1402, a technology provider 1420 such as home security service (like ADT® or Vivant®), and law enforcement 1430.

Typically, the server 1412 comprises one or more central processing units executing software and/or firmware to control and manage the other components within the system 1400. In one embodiment, the server 1412 comprises hardware and/or software more commonly referred to as a Multiple Virtual Storage (MVS), OS/390, zSeries/Operating System (z/OS), UNIX, Linux, or Windows system.

The server may comprise a server cluster with firewalls, load balancer, and database servers having Apache® and/or other software applications well-known to those of skill in the art. The server 1412, in the shown embodiment, comprises a database management system (DBMS) 1410 or relational database management system (RDBMS), such as Oracle, MySQL, SQL, FireBird, IBM DB2®, or the like.

The server 1412 is in logical communication with the DPDs of one or more consumers home owners 1402 and law enforcement 1430 through a networked environment 1416, such as local area network (LAN) or wide area network (WAN). The server 1412 may communicate with home owners 1402, law enforcement 1430, and/or the technology provider 1416 using variations of the Simple Mail Transfer Protocol (SMTP), Internet Message Access Protocol (IMAP), Post Office Protocol (POP), or other protocols well-known to those of skill in the art.

In the present invention, the server 1412 routes information between the device 1100 and a technology provider 1420 such as a home security service company.

The server 1412 is in logical communication via a LAN with the device 1100; and, in some embodiments, with the cellular phones or DPDs of home owners 1402.

In the present invention, as further described in detail above and below, a notification is relayed wireless from the device 1100 over the LAN when the device 1100 is removed or even moved. The device 1100 may comprise proximity sensors and/or motion detectors as known to those of skill in the art for detecting movement or removal and pushing a notification 1406 via the LAN to the technology provider 1420 who may then push a notification 1408 to law enforcement 1430.

Notifications 1406, 1408 are stored as computer files 1418 in storage 1422.

The home owner may comprise any person, company, or organization that is tasked with safeguarding property or firearms.

In various embodiments, the notifications 1406, 1408 are pushed/relayed using programs well-known to those of skill in the art, such as Microsoft Outlook, Thunderbird, Yahoo! Mail, and the like. In other embodiments, the notifications 1406, 1408 are relayed using applications or APIs from a social media provider such as Google®, Facebook®, Twitter®, Instagram®, Snapchat®, or other social media providers known to those of skill in the art. The notifications may be relayed to Google®, Bing®, Yahoo! or another search engine provider.

In various embodiments, the notifications 1406, 1408 may comprise an SMS short message sent to the home owner 1402.

In is an object of the present invention to provide gun locks which interface with home automated security alarm systems and which have the capacity to wireless interconnect gun locks using industry standards with home automation systems. Home automated security alarms for gun locks may use a radio frequency and or waves, Z-Wave, Zigby, RFID, Wi-Fi, Bluetooth, 2.4 GHz band, 1 GHz, and or any other wireless low or high frequency communication to include frequencies from 400 MHz-900 MHz, Cellular, GSM, and or standard industry signals to communicate with a control panel affixed in the home. The control panel may in turn will notify the home owners 1402 and the technology provider 1418 that a gun and or rifle has been moved or tampered with. When and if the monitoring center notifies the local law enforcement 1430, such notification 1406, 1408 will give the law enforcement 1430 a warning that an unauthorized person in the home may have a weapon in their possession. The home owner 1402 will also receive a push notification on their cell phone that their gun is being tampered with. In various embodiments, the device 1100 is also configured with cameras which photograph the environment around the device 1100 in response to movement or removal of the device 1100 from a firearm.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A gun lock for disabling a firearm, the gun lock comprising:

a left shackle adapted to affix over a trigger guard and a slide of a firearm, wherein the left shackle is hingedly affixed on a top edge to a right shackle, the left shackle defining a hollow interior recess contoured to closely envelope one or more of a trigger guard, slide and barrel of a firearm;

a right shackle adapted to affix over a barrel and a slide of a firearm, wherein the right shackle is hingedly affixed on a top edge to a left shackle, the left shackle defining an upper hollow interior recess contoured to closely envelope slide and barrel of the firearm and a lower hollow interior recess contoured to closely envelope a trigger guard of the firearm;

a left cantilever jutting laterally from an inside surface of the left shackle adapted to position beneath the slide of the firearm and above the trigger of the firearm;

a right cantilever jutting laterally from an inside surface of the right shackle adapted to position beneath the slide of the firearm and above the trigger of the firearm;

a locking mechanism adapted to interlock the right shackle and left shackle together over a slide and trigger guard of a firearm;

a speaker housed in a portion of one of the left shackle and the right shackle below the left and right cantilevers and adapted to emanate an alarm; the speaker jutting forwardly outward from an exterior surface of the left shackle or the right shackle so as to define a forwardmost extending structure of the gun lock;

wherein one of the left cantilever and the right cantilever defines an upper recess shaped to contour an exterior surface of a semiautomatic firearm and defines a lower recess shaped to contour a trigger guard.

2. The gun lock of claim 1, wherein the left shackle and right shackle each further comprise one or more interlocking teeth collectively forming a hinge.

3. The gun lock of claim 1, further comprising a power supply to supply power to the speaker.

4. The gun lock of claim 1, further comprising a biometric lock.

5. The gun lock of claim 1, further comprising a wireless transceiver for connecting to a LAN.

6. The gun lock of claim 1, wherein the gun lock is adapted to share media wirelessly using short-wavelength UHF radio waves in the ISM bank 2.400 to 2.485 GHz from fixed and mobile devices.

7. The gun lock of claim 1, wherein the gun lock is adapted to automatically relay a notification wirelessly that the assembly has been one of removed and moved.

8. The gun lock of claim 1, wherein the gun lock forms an arcuate upper surface when the left shackle and right shackle are interlocked around the firearm.

9. The gun lock of claim 1, wherein the components of the firearm enveloped by the gunlock comprise: a midsection of the slide, the trigger guard, the ejection port.

10. A gun lock for disabling a firearm, the gun lock comprising:

a left shackle adapted to affix over a trigger guard and a slide of a firearm, wherein the left shackle is hingedly affixed to a right shackle, the left shackle defining a hollow interior recess contoured to closely envelope a trigger guard and ejection port of a firearm;

a right shackle adapted to affix over a barrel and a slide of a firearm, wherein the right shackle is hingedly affixed to a left shackle, the left shackle defining an upper hollow interior recess contoured to closely envelope slide and barrel of the firearm and a lower hollow interior recess contoured to closely envelope a trigger guard and ejection port of the firearm;

a cantilever jutting laterally from an inside surface of one of the left shackle and the right shackle, the cantilever adapted to position beneath the slide of the firearm and above the trigger of the firearm;

a locking mechanism adapted to interlock the right shackle and left shackle together over the firearm;

a speaker housed in a portion of one of the left shackle and the right shackle below the cantilever and adapted to emanate an alarm; the speaker jutting forwardly outward from an exterior surface of the left shackle or the right shackle so as to define a forwardmost extending structure of the gun lock;

wherein one of the cantilever defines an upper recess shaped to contour an exterior surface of a semiautomatic firearm and defines a lower recess shaped to contour a trigger guard;

wherein the gun lock does not envelope a handle nor a hammer of the firearm.

* * * * *